United States Patent [19]

Shilling et al.

[11] 4,102,713

[45] Jul. 25, 1978

[54] SILICON STEEL AND PROCESSING THEREFORE

[75] Inventors: Jack W. Shilling, Monroeville; Clarence L. Miller, Jr.; Amitava Datta, both of Pittsburgh, all of Pa.

[73] Assignee: Allegheny Ludlum Industries, Inc., Pittsburgh, Pa.

[21] Appl. No.: 696,967

[22] Filed: Jun. 17, 1976

[51] Int. Cl.[2] ..... H01F 1/04

[52] U.S. Cl. ..... 148/113; 148/31.5

[58] Field of Search ..... 148/113, 31.5, 27, 16, 148/111; 427/127, 129

[56] References Cited

U.S. PATENT DOCUMENTS

| | | | |
|---|---|---|---|
| 3,222,228 | 12/1965 | Stanley et al. | 148/16 |
| 3,627,594 | 12/1971 | Yamamoto et al. | 148/113 |
| 3,676,227 | 7/1972 | Matsumoto et al. | 148/111 |
| 3,697,322 | 10/1972 | Lee et al. | 148/113 |
| 3,700,506 | 10/1972 | Tanaka et al. | 148/111 |
| 3,868,280 | 2/1975 | Yamamoto et al. | 148/113 |
| 3,905,842 | 9/1975 | Grenoble | 148/111 |
| 3,941,621 | 3/1976 | Lee et al. | 148/27 |
| 3,945,862 | 3/1976 | Lee et al. | 148/113 |
| 3,957,546 | 5/1976 | Fiedler | 148/111 |
| 4,000,015 | 12/1976 | Malagari | 148/111 |
| 4,030,950 | 6/1977 | Shilling et al. | 148/113 |

*Primary Examiner*—Walter R. Satterfield

*Attorney, Agent, or Firm*—Vincent G. Gioia; Robert F. Dropkin

[57] ABSTRACT

A process for producing electromagnetic silicon steel having a cube-on-edge orientation and a permeability of at least 1870 ($G/O_e$) at 10 oersteds. The process includes the steps of: preparing a melt of silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel; decarburizing said steel; applying a refractory oxide coating containing both boron and an oxide less stable than $SiO_2$ at temperatures up to 2150° F; and final texture annealing said steel.

13 Claims, No Drawings

SILICON STEEL AND PROCESSING THEREFORE

The present invention relates to an improvement in the manufacture of grain-oriented silicon steels.

U.S. Pat. Nos. 3,873,381, 3,905,842, 3,905,843 and 3,957,546 describe processing for producing boron-inhibited grain oriented electromagnetic silicon steel. Described therein are processes for producing steel of high magnetic quality from boron-bearing silicon steel melts. Through this invention, we now provide a process which improves upon those of the cited patents. Speaking broadly, we provide a process which improves upon those of said patents by incorporating controlled amounts of both boron and an oxide less stable than $SiO_2$ at temperatures up to 2150° F, in the coating which is applied prior to the final texture anneal.

It is accordingly an object of the present invention to provide an improvement in the manufacture of grain-oriented silicon steels.

In accordance with the present invention a melt of silicon steel containing from 0.02 to 0.06% carbon, from 0.0006 to 0.0080% boron, up to 0.0100% nitrogen, no more than 0.008% aluminum and from 2.5 to 4.0% silicon is subjected to the conventional steps of casting, hot rolling, one or more cold rollings, an intermediate normalize when two or more cold rollings are employed, decarburizing, application of a refractory oxide coating and final texture annealing; and to the improvement comprising the steps of coating the surface of the steel with a refractory oxide coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight, of at least one other substance from the group consisting of boron and compounds thereof, said coating containing at least 0.1% by weight, of boron;

(c) from 0.5 to 100 parts, by weight, of at least one oxide less stable than $SiO_2$ at temperatures up to 2150° F, said oxide being of an element other than boron;

(d) up to 40 parts, by weight, of $SiO_2$;

(e) up to 20 parts, by weight, of inhibiting substances or compounds thereof; and (f) up to 10 parts, by weight, of fluxing agents;

and final texture annealing said steel with said coating thereon. For purpose of definition, "one part" equals the total weight of (a) hereinabove, divided by 100.

Specific processing, as to the conventional steps, is not critical and can be in accordance with that specified in any number of publications including U.S. Pat. No. 2,867,557 and the other patents cited hereinabove. Moreover, the term casting is intended to include continuous casting processes. A hot rolled band heat treatment is also includable within the scope of the present invention. It is, however, preferred to cold roll the steel to a thickness no greater than 0.020 inch, without an intermediate anneal between cold rolling passes; from a hot rolled band having a thickness of from about 0.050 to about 0.120 inch. Melts consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron, have proven to be particularly adaptable to the subject invention. Boron levels are usually in excess of 0.0008%. Steel produced in accordance with the present invention has a permeability of at least 1870 ($G/O_e$) at 10 oersteds. Preferably, the steel has a permeability of at least 1900 ($G/O_e$) at 10 oersteds and a core loss of no more than 0.700 watts per pound at 17 kilogauss.

Inclusion of an oxide less stable than $SiO_2$ at temperatures up to 2150° F is particularly significant in a coating which is applied to a boron-inhibited silicon steel. By an oxide less stable than $SiO_2$, is meant one having a free energy of formation of less negative than $SiO_2$ under the conditions encountered during a high temperature anneal. However, insofar, as these conditions are difficult to determine a standard free energy of formation diagram can be used to determine stability. Boron inhibited silicon steels are final normalized at relatively low dew points, as the magnetic properties of said steels improve with the use of low dew points. High dew points deboronize a boron-bearing steel, thereby reducing the effect of boron as an inhibitor; and as a result thereof cause a deterioration in magnetic properties. A scale low in oxygen (as oxides, particularly $SiO_2$) is, however, produced when a low dew point final normalize is employed; and as a certain amount of oxygen in the scale is required to render a surface susceptible to formation of a high quality base coating, a means of adding oxygen to the scale (as oxides, particularly $SiO_2$) must be found. One such means is to add oxygen through a coating containing an oxide less stable than $SiO_2$ at temperatures up to 2150° F. The inclusion of such an oxide allows for the formation of a high quality base coating on boron-inhibited silicon steels which are decarburized at a dew point of from +20° to +110° F; and which is generally from +40° to +85° F. The atmosphere for the decarburization is one which is hydrogen-bearing, and generally one of hydrogen and nitrogen. Temperatures of from 1400° to 1550° F are particularly desirable for the final normalize as decarburization proceeds most effectively at a temperature of about 1475° F. Time at temperature is usually from ten seconds to ten minutes.

The oxide less stable than $SiO_2$ should be present in a range of from 0.5 to 100 parts, by weight, as described hereinabove. A level of at least 1 part is, however, preferred. Maximum amounts are generally less than 30 parts, by weight. Typical oxides are those of manganese and iron. To date, $MnO_2$ is preferred.

The specific mode of applying the coating of the subject invention is not critical thereto. It is just as much within the scope of the subject invention to mix the coating with water and apply it as a slurry, as it is to apply it electrolytically. Likewise, the constituents which make up the coating can be applied together or as individual layers. It is, however, preferred to have at least 0.2%, by weight, of boron in the coating. Boron improves the magnetic properties of the steel. Typical sources of boron are boric acid, fused boric acid ($B_2O_3$), ammonium pentaborate and sodium borate. The additional inhibiting substances includable within the coating are usually from the group consisting of sulfur, sulfur compounds, nitrogen compounds, selenium and selenium compounds. Typical fluxing agents include lithium oxide, sodium oxide and other oxides known to those skilled in the art.

Also includable as part of the subject invention is the steel in its primary recrystallized state with the coating of the subject invention adhered thereto. The primary recrystallized steel has a thickness no greater than 0.020 inch and is, in accordance with the present invention, suitable for processing into grain oriented silicon steel having a permeability of at least 1870 ($G/O_e$) at 10 oersteds. Primary recrystallization takes place during the final normalize.

The following examples are illustrative of several aspects of the invention.

EXAMPLE I

Two samples (Samples A and B) of silicon steel were cast and processed into silicon steel having a cube-on-edge orientation. Although they are from different heats of steel, their chemistries are very similar, as shown hereinbelow in Table I.

TABLE I

| Sample | Composition (wt. %) | | | | | | | | |
|---|---|---|---|---|---|---|---|---|---|
| | C | Mn | S | B | N | Si | Cu | Al | Fe |
| A | 0.037 | 0.038 | 0.023 | 0.0014 | 0.0048 | 3.25 | 0.37 | 0.004 | Bal. |
| B | 0.029 | 0.040 | 0.020 | 0.0013 | 0.0048 | 3.13 | 0.27 | 0.003 | Bal. |

Processing for the samples involved soaking at an elevated temperature for several hours, hot rolling to a nominal gage of 0.080 inch, hot roll band normalizing at a temperature of approximately 1740° F, cold rolling to final gage, decarburizing, coating as described hereinbelow in Table II, and final texture annealing at a maximum temperature of 2150° F in hydrogen.

TABLE II

| Sample | MgO (Parts, by wt.) | $H_3BO_3$ (Parts, by Wt.) | $MnO_2$ (Parts, by wt.) |
|---|---|---|---|
| A | 100 | 4.6 (0.8% B) | 0 |
| B | 100 | 4.6 | 10 |

Note that the coating applied to Sample A was free of $MnO_2$, whereas that applied to Sample B had 10 parts, by weight, of $MnO_2$.

The coating formed during the final texture anneal was subsequently examined, after excess MgO was scrubbed off. Table III reports the results of said examination.

TABLE III

| Sample | Coating |
|---|---|
| A | Bare regions, Thin and porous, Blue discoloration, Extensive anneal pattern |
| B | Excellent, No anneal pattern, Glossy No bare steel visible |

Significantly, a high quality coating formed on Sample B which was processed in accordance with the subject invention, and not on Sample A which was not. The coating applied to Sample B had $MnO_2$ whereas that applied to Sample A was devoid of $MnO_2$; and, as discussed hereinabove, the present invention requires a coating which contains an oxide less stable than $SiO_2$.

EXAMPLE II

Eight additional samples (Samples C, C', D, D', E, E', F and F') were cast and processed into silicon steel having a cube-on-edge orientation. The chemistry of the samples appears hereinbelow in Table IV.

TABLE IV

| Composition (wt. %) | | | | | | | | |
|---|---|---|---|---|---|---|---|---|
| C | Mn | S | B | N | Si | Cu | Al | Fe |
| 0.030 | 0.034 | 0.020 | 0.0011 | 0.0043 | 3.12 | 0.35 | 0.004 | Bal. |

Processing for the samples involved soaking at an elevated temperature for several hours, hot rolling to a nominal gage of 0.080 inch, hot roll band normalizing at a temperature of approximately 1740° F, cold rolling to final gage, decarburizing as described hereinbelow in Table V, coating as described hereinbelow in Table VI, and final texture annealing at a maximum temperature of 2150° F in hydrogen.

TABLE V

| Sample | Temp. (° F) | Time (Mins.) | Dew Point (° F) | Atmosphere (%) |
|---|---|---|---|---|
| C, D, E, F | 1475 | 2 | + 30 | 100H |
| C', D', E', F' | 1475 | 2 | + 50 | 80N-20H |

TABLE VI

| Sample | MgO (Parts, by wt.) | $H_3BO_3$ (Parts, by wt.) | $MnO_2$ (Parts, by wt.) |
|---|---|---|---|
| C, C' | 100 | 4.6 (0.8% B) | 0 |
| D, D' | 100 | 4.6 | 5.0 |
| E, E' | 100 | 4.6 | 20 |
| F, F' | 100 | 4.6 | 40 |

The coatings formed during the final texture anneal were subsequently examined, after excess MgO was scrubbed off. Samples C and C' with 0 parts $MnO_2$ in the coating had visible regions of bare steel, whereas a continuous reacted coating was present when $MnO_2$ was added.

Franklin values for the coated samples were determined at 900 psi. A perfect insulator has a Franklin value of 0, whereas a perfect conductor has a Franklin value of 1 ampere. The results are reproduced hereinbelow in Table VII.

TABLE VII

| Sample | Franklin Value |
|---|---|
| C | 0.95 |
| C' | 0.93 |
| D | 0.87 |
| D' | 0.81 |
| E | 0.76 |
| E' | 0.58 |
| F | 0.84 |
| F' | 0.67 |

Note how the Franklin value decreases with $MnO_2$ additions. Also note that the C', D', E' and F' samples had respectively lower Franklin values than did the C, D, E and F samples. The C, D, E and F samples, as noted in Table V, were decarburized in a drier atmosphere.

EXAMPLE III

Nine additional samples (Samples G through O) were cast and processed into silicon steel having cube-on-edge orientation. The chemistry of the samples appears hereinbelow in Table VIII.

TABLE VIII

| C | Mn | S | Composition (wt. %) B | N | Si | Cu | Al | Fe |
|---|---|---|---|---|---|---|---|---|
| 0.032 | 0.036 | 0.020 | 0.0013 | 0.0043 | 3.15 | 0.35 | 0.004 | Bal. |

Processing for the samples involved soaking at an elevated temperature for several hours, hot rolling to a nominal gage of 0.080 inch, hot roll band normalizing at a temperature of approximately 1740° F, cold rolling to final gage, decarburizing, coating as described hereinbelow in Table IX, and final texture annealing at a maximum temperature of 2150° F in hydrogen.

TABLE IX

| Sample | MgO (Parts, by wt.) | $MnO_2$ (Parts, by wt.) | $H_3BO_3$ (Parts, by wt.) |
|---|---|---|---|
| G | 100 | 2.5 | 0 |
| H | 100 | 5 | 0 |
| I | 100 | 10 | 0 |
| J | 100 | 2.5 | 2.3 (0.4% B) |
| K | 100 | 5 | 2.3 |
| L | 100 | 10 | 2.3 |
| M | 100 | 2.5 | 4.6 (0.8% B) |
| N | 100 | 5 | 4.6 |
| O | 100 | 10 | 4.6 |

The samples were tested for permeability and core loss. The results of the tests appear hereinbelow in Table X.

TABLE X

| Sample | Permeability (at $100_e$) | Core Loss (WPP at 17 KB) |
|---|---|---|
| G | 1852 | 0.757 |
| H | 1878 | 0.704 |
| I | 1870 | 0.708 |
| J | 1900 | 0.692 |
| K | 1904 | 0.677 |
| L | 1898 | 0.680 |
| M | 1905 | 0.660 |
| N | 1911 | 0.652 |
| O | 1882 | 0.698 |

The benefit of boron in the coating is clearly evident from Table X. Improvement in both permeability and core loss can be attributed thereto. The permeability and core loss for Sample H, to which boron was not applied, were 1852 and 0.757; whereas the respective values for Samples J and M, to which boron was applied, were 1900 and 1905, and 0.692 and 0.660. Best magnetic properties were obtained when the boron level was in excess of 0.5%, by weight.

EXAMPLE IV

Two additional samples (Samples P and Q) were cast and processed into silicon steel having a cube-on-edge orientation. The chemistry of the samples appears hereinbelow in Table XI.

TABLE XI

| C | Mn | S | Composition (wt. %) B | N | Si | Cu | Al | Fe |
|---|---|---|---|---|---|---|---|---|
| 0.031 | 0.032 | 0.020 | 0.0011 | 0.0047 | 3.15 | 0.32 | 0.004 | Bal. |

Processing for the samples involved soaking at an elevated temperature for several hours, hot rolling to a nominal gage of 0.080 inch, hot roll band normalizing at a temperature of approximately 1740° F, cold rolling to final gage, decarburizing, coating as described hereinbelow in Table XII, and final texture annealing at a maximum teperature of 2150° F in hydrogen.

TABLE XII

| Sample | MgO (Parts, by wt.) | $Fe3O_4$ (Parts, by wt.) | $H_3BO_3$ (Parts, by wt.) | $SiO_2$ (Parts, by wt.) |
|---|---|---|---|---|
| P | 100 | 5 | 4.6 (0.8% B) | 0 |
| Q | 100 | 5 | 4.6 | 7.3 |

The samples were tested for permeability and core loss. Franklin values at 900 psi were also determined. The results of the tests appear hereinbelow in Table XIII.

TABLE XIII

| Sample | Permeability (at $100_e$) | Core Loss (WPP at 17 KB) | Franklin Value |
|---|---|---|---|
| P | 1919 | 0.672 | 0.91 |
| Q | 1931 | 0.671 | 0.90 |

The results appearing hereinbelow in Table XIII show that oxidizers other than $MnO_2$ can be used. $Fe_3O_4$ is a suitable substitution for $MnO_2$, as are $Fe_2O_3$ and others. Table XIII also shows that $SiO_2$ can be beneficial to the coating. When an addition, $SiO_2$ is generally present at a level of at least 0.5 parts, by weight. Levels of at least 3 parts, by weight, are however preferred. Although $SiO_2$ can be added in various ways, colloidal silica is preferred.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation and a permeability of at least 1870 ($G/O_e$) at 10 oersteds, which process includes the steps of: preparing a melt of silicon steel consisting essentially of, by weight, from 0.02 to to 0.06% carbon, from 0.015 to 0.15% manganese, from 0.01 to 0.05% of material from the group consisting of sulfur and selenium, from 0.0006 to 0.0080% boron, up to 0.0100% nitrogen, up to 1.0% copper, no more than 0.008% aluminum, from 2.5 to 4.0% silicon, balance iron; casting said steel; hot rolling said steel; cold rolling said steel; decarburizing said steel in a hydrogen-bearing atmosphere having a dew point of from +20° to +110° F; applying a refractory oxide base coating to said steel; and final texture annealing said steel; the improvement comprising the steps of coating the surface of said steel with a refractory oxide base coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight, of other substances from the group consisting of boron and compounds thereof; said coating containing at least 0.1%, by weight, of boron;

(c) from 0.5 to 100 parts, by weight, of at least one oxide less stable than $SiO_2$ at temperatures up to 2150° F, said oxide being of an element other than boron;

(d) Up to 40 parts, by weight, of $SiO_2$;

(e) up to 20 parts, by weight, of inhibiting substances or compounds thereof; and (f) up to 10 parts, by weight, of fluxing agents; and final texture annealing said steel with said coating thereon; said annealed steel having a substantially continuous reacted coating; the quality of the coating being, in part, attributable to the inclusion of an oxide less stable than $SiO_2$ at temperatures up to 2150° F; the steel's magnetic properties being, in part, attributable to the inclusion of boron in the base coating.

2. The improvement according to claim 1, wherein said melt has at least 0.0008% boron.

3. The improvement according to claim 2, wherein said coating has at least 0.2% boron.

4. The improvement according to claim 2, wherein said oxide less stable than $SiO_2$ is from the group consisting of oxides of manganese and iron.

5. The improvement according to claim 4, wherein said oxide is an oxide of manganese.

6. The improvement according to claim 2, wherein said coating has at least 1 part, by weight, of at least one oxide less stable than $SiO_2$.

7. The improvement according to claim 2, wherein said coating has at least 0.5 parts, by weight, of $SiO_2$.

8. The improvement according to claim 2, wherein said inhibiting substances or compounds thereof are from the group consisting of sulfur, sulfur compounds, nitrogen compounds, selenium and selenium compounds.

9. The improvement according to claim 2, wherein said hot rolled steel has a thickness of from 0.050 to about 0.120 inch and wherein said hot rolled steel is cold rolled to a thickness no greater than 0.020 inch without an intermediate anneal between cold rolling passes.

10. The improvement according to claim 1, wherein said dew point is from +40° to +85° F.

11. The improvement according to claim 10, wherein said hydrogen-bearing atmsophere consists essentially of hydrogen and nitrogen.

12. The improvement according to claim 1, wherein said steel has a permeability of at least 1900 ($G/O_e$) at 10 oersteds and a core loss of no more than 0.700 watts per pound at 17 kilogauss.

13. A cube-on-edge oriented silicon steel having a permeability of at least 1870 ($G/O_e$) at 10 oersteds, and made in accordance with the process of claim 2.

* * * * *